US012808100B2

(12) United States Patent
Fallon et al.

(10) Patent No.: US 12,808,100 B2
(45) Date of Patent: Nov. 24, 2026

(54) BRAIDED ABSORBENT MATERIAL FOR USE IN A CONSUMABLE OF A NON-COMBUSTIBLE AEROSOL PROVISION SYSTEM

(71) Applicant: British American Tobacco (Investments) Limited, London (GB)

(72) Inventors: Gary Fallon, London (GB); Paul Gibson, London (GB); Scott George Boham, London (GB); Robert Whiffen, London (GB); Sam Whiffen, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 511 days.

(21) Appl. No.: 18/038,249

(22) PCT Filed: Oct. 19, 2021

(86) PCT No.: PCT/GB2021/052696
§ 371 (c)(1),
(2) Date: May 23, 2023

(87) PCT Pub. No.: WO2022/117980
PCT Pub. Date: Jun. 9, 2022

(65) Prior Publication Data

US 2023/0413903 A1 Dec. 28, 2023

(30) Foreign Application Priority Data

Dec. 1, 2020 (GB) ..... 2018893

(51) Int. Cl.
*D04C 1/06* (2006.01)
*A24F 40/44* (2020.01)
(Continued)

(52) U.S. Cl.
CPC ..... *D04C 1/06* (2013.01); *A24F 40/44* (2020.01); *A24F 40/465* (2020.01); *A24F 40/70* (2020.01); *D04C 1/02* (2013.01)

(58) Field of Classification Search
None
See application file for complete search history.

(56) References Cited

U.S. PATENT DOCUMENTS 5,124,200 A * 6/1992 Mallonee ..... D04H 1/76 428/137
5,863,196 A * 1/1999 Rockwell ..... F23D 3/08 428/374

(Continued)

FOREIGN PATENT DOCUMENTS

EP 3009019 A1 10/2014

OTHER PUBLICATIONS

International Search Report for corresponding application PCT/GB2021/052696 filed Oct. 19, 2021; Mail date Jan. 20, 2022.

(Continued)

*Primary Examiner* — Jocelyn Bravo
(74) *Attorney, Agent, or Firm* — CANTOR COLBURN LLP

(57) ABSTRACT

A method of manufacturing a braided absorbent material (50) for a consumable of a non-combustible aerosol provision system is disclosed. It comprises braiding strands of material (52) around the outside of a continuous rod of absorbent material (54) to form a continuous rod of braided material; and cutting the continuous rod of braided material into lengths of braided absorbent material. Each length of braided absorbent material includes at least a portion of the rod of absorbent material. A braided absorbent material comprising strands of material braided around the outside of a rod of absorbent material is also disclosed. The absorbent material (54) is capable of wicking aerosol generating (Continued)

material. The stands of material (52) may be magnetic metal wire to be used in an induction heating system, or may be flavour impregnated.

13 Claims, 11 Drawing Sheets

(51) Int. Cl.

| | |
|---|---|
| ***A24F 40/465*** | (2020.01) |
| ***A24F 40/70*** | (2020.01) |
| ***D04C 1/02*** | (2006.01) |

(56) References Cited

U.S. PATENT DOCUMENTS

| | | | | |
|---|---|---|---|---|
| 6,272,966 | B1 * | 8/2001 | Montle | D04C 1/12 87/6 |
| 2014/0261487 | A1 * | 9/2014 | Chapman | A24F 40/44 87/6 |
| 2019/0313701 | A1 | 10/2019 | Cadieux | |
| 2023/0132310 | A1 * | 4/2023 | Frahmann | D04C 3/38 87/44 |

OTHER PUBLICATIONS

Written Opinion for corresponding application PCT/GB2021/052696 filed Oct. 19, 2021; Mail date Jan. 20, 2022.

* cited by examiner

BRAIDED ABSORBENT MATERIAL FOR USE IN A CONSUMABLE OF A NON-COMBUSTIBLE AEROSOL PROVISION SYSTEM

TECHNICAL FIELD

The present invention relates to a braided absorbent material, a method of manufacturing the braided absorbent material and a consumable for a non-combustible aerosol provision system comprising the braided absorbent material.

BACKGROUND

Electronic aerosol provision systems such as heating products are configured to release one or more compounds by heating, but not burning, a substrate material to generate an aerosol for user inhalation. Generally, the heating products are configured to heat a portion of tobacco or a tobacco derived product (e.g., reconstituted tobacco) to generate the aerosol. The substrate material is usually formed into a rod which is typically surrounded by a paper layer and includes a mouthpiece end, which is an end that the user inhales on (i.e., puts in their mouth) during use. These rods are broadly similar in appearance to combustible cigarettes. The rods are inserted into the aerosol provision device and electrical power is subsequently supplied to the heating element, from a power source such as a battery, to aerosolise portions of the solid substrate in the vicinity of the heating element. Such devices are usually provided with one or more air inlet holes located away from where the user inhales on the system. When a user inhales/sucks on the mouthpiece end of the rods, air is drawn in through the inlet holes, through the rod and past the substrate source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece for inhalation by the user.

Such rods are formed of low cost components and are generally designed to be thrown away after use (i.e., after the aerosolisable material has been aerosolised). Traditionally, the rods comprise a plastic tube with a metallic part, such as a wire coil, used as a susceptor to heat the substrate material, which typically comprises cotton fibres. Recent approaches have sought to design away from using plastics in the rods and to provide more structure around the substrate material in order to better control the uniformity of the substrate material, such as the cotton fibres, during the manufacturing process as cotton fibre has a tendency to expand in size or splay out when it is not held in place.

Various approaches are described herein which seek to help address or mitigate some of the issues discussed above.

SUMMARY

The disclosure is defined in the appended claims.

In accordance with some embodiments described herein, there is provided a method of manufacturing a braided absorbent material for a consumable of a non-combustible aerosol provision system. The method comprises braiding strands of material around the outside of a continuous rod of absorbent material to form a continuous rod of braided material and cutting the continuous rod of braided material into lengths of braided absorbent material, where each length includes at least a portion of the rod of absorbent material.

The braiding may create a uniform pattern of strands of material around the outside of the continuous rod of absorbent material.

The continuous rod of absorbent material may be continuous in a first direction and the cutting may be performed perpendicular to the first direction.

A braiding machine may perform the braiding, and the continuous rod of absorbent material may be drawn through an aperture of the braiding machine. The strands of material may be supplied from three or more bobbins on the braiding machine. The braiding machine may comprise a controller configured to match the braiding to a draw speed of the continuous rod of absorbent material through the aperture of the braiding machine. The continuous rod of absorbent material may be supplied from a reel.

The absorbent material may be cotton fibres.

The strands of material comprise at least a first material and a second material, where the first material is different to the second material. The braiding may create a first pattern of strands the first material and a second pattern of strands of the second material, where the first pattern is different to the second pattern. The first material may be metal wire and the second material may be cotton thread.

The continuous rod of absorbent material may be formed by wrapping the absorbent material around a continuous core of material.

One or more additional materials may be laid on the outside of the continuous rod of absorbent material before the braiding.

In accordance with some embodiments described herein, there is provided a braided absorbent material for consumable of a non-combustible aerosol provision system manufactured using the method described herein.

In accordance with some embodiments described herein, there is provided a braided absorbent material for consumable of a non-combustible aerosol provision system, the braided absorbent material comprising strands of material braided around the outside of a rod of absorbent material.

In accordance with some embodiments described herein, there is provided a non-combustible aerosol provision system comprising the consumable as described herein.

These aspects and other aspects will be apparent from the following detailed description. In this regard, particular sections of the description are not to be read in isolation from other sections.

BRIEF DESCRIPTION OF DRAWINGS

Embodiments of the invention will now be described, by way of example only, with reference to accompanying drawings, in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of articles and systems discussed herein which are not described in detail may be implemented in accordance with any conventional techniques for implementing such aspects and features.

According to the present disclosure, a "non-combustible" aerosol provision system is one where a constituent aerosol-generating material of the aerosol provision system (or component thereof) is not combusted or burned in order to facilitate delivery of at least one substance to a user. One such example is a powered non-combustible aerosol provision system.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device. In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system may comprise a power source and a controller. The power source may, for example, be an electric power source or an exothermic power source. In some embodiments, the exothermic power source comprises a carbon substrate which may be energised so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

Figure 1:
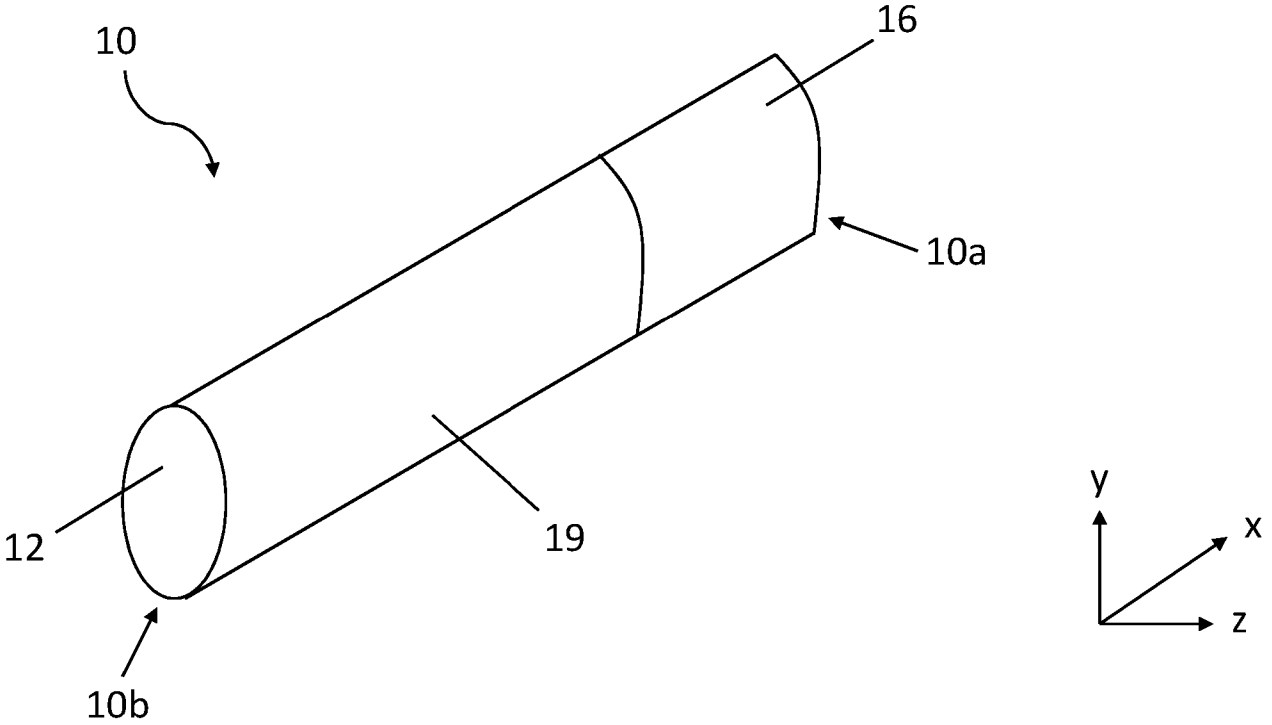
FIG. 1 schematically illustrates a consumable for a non-combustible aerosol provision system according to principles of the present disclosure.

FIG. 1 schematically illustrates, in perspective view, an example of a consumable 10 for a non-combustible aerosol provision system. A consumable is an article comprising or consisting of a substance to be delivered to a user during use of a non-combustible aerosol provision system. In the present example, the substance to be delivered is an aerosol-generating material 12, part or all of which is intended to be consumed during use by a user. The aerosol-generating material may also be referred herein to as an aerosolisable material. In some embodiments, the substance to be delivered may be a material that is not intended to be aerosolised. As appropriate, either the aerosolisable material or the material that is not intended to be aerosolised may comprise one or more active constituents, one or more flavours, one or more aerosol-former materials, and/or one or more other functional materials. The aerosolisable material 12 may comprise any suitable solid or gel aerosolisable materials.

As shown in FIG. 1, the consumable 10 has a generally cylindrical shape. The size of the consumable 10 is approximately 7 cm in length (along an x-direction) and approximately 0.8 cm in diameter (along a y-/z-direction), although the consumable 10 may have different dimensions and shapes in different implementations.

The consumable 10 illustrated in FIG. 1 also comprises a wrapper 14 and a mouthpiece 16. In the present example, the aerosol-generating material 12 is formed into a generally rod-shaped/cylindrical element, and the wrapper 14 is wrapped around the outer surface of the aerosol-generating material 12. The wrapper 14 in this example is made of paper, but other materials such as card, metal foil (e.g., aluminium foil), or a laminated material, such as aluminium foil coated paper, may also be used in other implementations. In this example, the wrapper 14 acts as a physical barrier between the aerosol-generating material 12 and the external environment, thereby improving the handling of the consumable 10 by a user. Additionally, the wrapper 14 may act as an outer wrap to retain the cylindrical rod shape of the aerosol-generating material 12.

The cylindrical rod has a proximal end 10*a* and a distal end 10*b*. In the present example, the mouthpiece 16 is located at the proximal end 10*a*. The mouthpiece 16 is the part of the consumable 10 that engages with the lips of a user. In other words, the user places their lips around the mouthpiece 16 during use of the consumable 10, as explained further below. In some implementations, the wrapper 14 may be formed of multiple sub-layers stacked one on top of the other (i.e., in the radial direction of article 10), where at least one of the sub-layers extends the entire length of the consumable 10 and is wrapped around both the aerosol-generating material 12 and the mouthpiece 16 to retain the mouthpiece 16 at the proximal end 10*a* of the consumable 10. The mouthpiece 16 may be formed of any suitable porous material that is air permeable, e.g., a filter material such as cellulose acetate, a sponge, etc. It should be appreciated however that the mouthpiece 16 is optional and in some implementations the mouthpiece 16 is omitted.

The consumable 10 may comprise one or more other components, such as an aerosol-generating material storage area, an aerosol-generating material transfer component, an aerosol generation area, a housing, a filter, an aerosol-modifying agent and/or an aerosol-modifying agent release component, such as a capsule. The consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein. The susceptor may be substantially circular in cross-section, or have a non-circular cross-section to increase the area of contact with the consumable in order to improve the energy transfer between the device and the consumable. The cross-section of the susceptor may also vary along the length (in the x-direction) of the consumable. For example, the susceptor may taper inwardly or outwardly from one end of the consumable.

Figure 2:
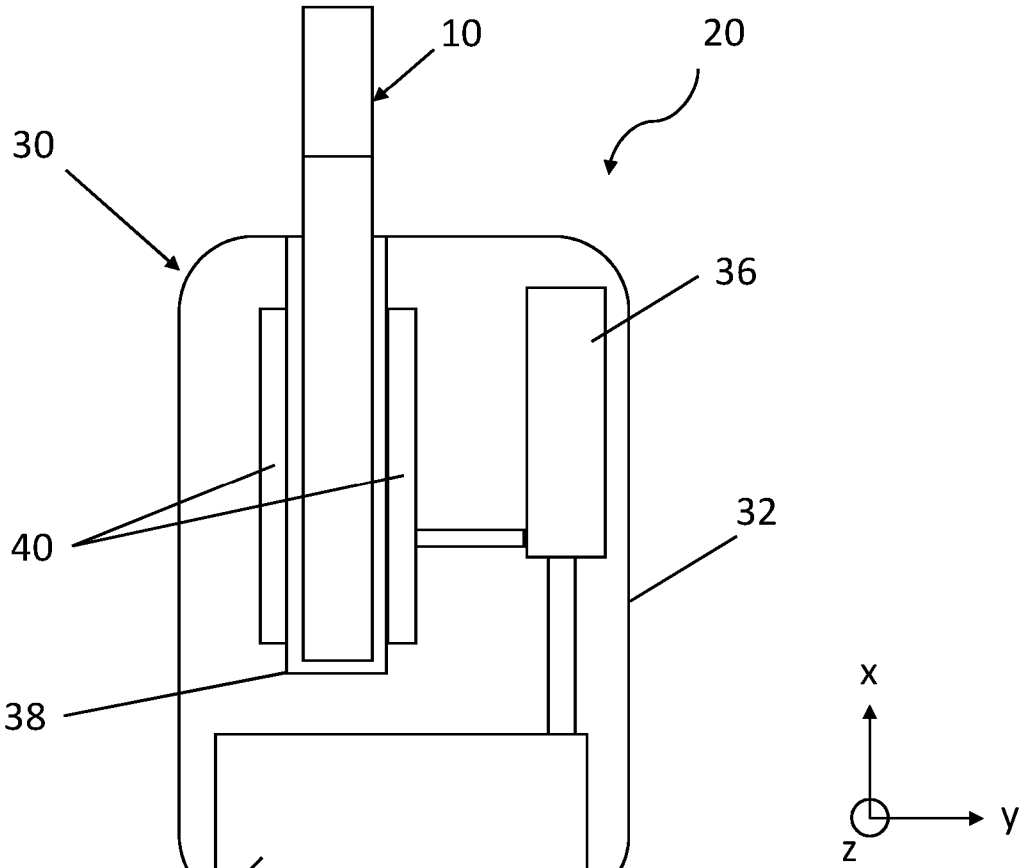
FIG. 2 schematically illustrates a non-combustible aerosol provision system comprising the consumable of FIG. 1 inserted into the non-combustible aerosol provision system according to principles of the present disclosure.

FIG. 2 schematically illustrates, in cross section, a non-combustible aerosol provision system 20 in accordance with principles of the present disclosure. The non-combustible aerosol provision system 20 includes the consumable 10 of FIG. 1 in addition to an aerosol provision device 30 (sometimes referred to herein as device part 30). The aerosol provision device 30 includes a housing 32, a power cell 34, a control circuitry 36, a receptacle 38 sized to receive the consumable 10 of FIG. 1, and a vaporiser which in this example takes the form of a heater 40 positioned adjacent the receptacle 38 and forming at least a part of the inner surface of the receptacle 38.

FIG. 2 is described with respect to the reference frame as indicated on the right-hand side of the figure; however, it should be appreciated that this reference frame is arbitrary and any other reference frame may be used to describe the various orientations and positions of the components of the aerosol provision device 30.

The aerosol provision device 30 includes a housing 32 which defines the outer surface of the device 30. The housing 32 in this example is approximately cuboidal and may have a height in the x-direction of approximately 10 cm, a width in the y-direction of approximately 5 cm, and a thickness in the z-direction of approximately 2 to 3 cm. The corners of the housing are slightly rounded in this example to provide a sleeker appearance and a more ergonomic design. However, it should be appreciated that in other implementations the housing 32 may take a different shape/size.

Inside the housing 32 is provided a power cell 34. The power cell 34 in this example is a rechargeable battery, such as a Lithium Ion or sodium based cell battery, which can be recharged when the device 30 is appropriately coupled to an external power source. The power cell 34 is configured to supply electrical power to the control circuitry 36, and ultimately the heater 40, during use of the device 30. The control circuitry 36 is coupled to the power cell 34 via any suitable form of electrical coupling, such as via wires 34*a* as shown in FIG. 2.

The control circuitry 36 is responsible for controlling a number of functions of the device 30. For example, the control circuitry 36 may control the power supply to the heater 40, the charging of the power cell 34 from an external source (e.g., via connection of an external power supply with a USB/microUSB port located in the housing 32, or via an induction based charging mechanism), or any other functionality such as data communication to a host computer (e.g., a personal PC, smartphone, etc.). The control circuitry 36 may include a (micro)controller, processor, ASIC or similar form of control chip in order to realise this control functionality. Moreover, the control circuitry may be formed on or mounted to a printed circuit board (PCB). Note also that the functionality provided by the control circuitry 36 may be split across multiple circuit boards and/or across components which are not mounted to a PCB, and these additional components and/or PCBs can be located as appropriate within the housing. For example, the functionality of the control circuitry for controlling the (re)charging functionality of the battery 32 may be provided separately (e.g. on a different PCB) from the functionality for controlling the discharge (i.e., for providing power to the heater).

The device 30 further includes a receptacle 38 sized to receive at least a part of the consumable 10. The receptacle in this example is formed as a cylindrical recess extending in the x-direction by a distance approximately two-thirds the length of the consumable 10, e.g., 5 cm. The consumable 10 is inserted into the receptacle 38 distal end 10*b* first. When fully inserted, the distal end of the consumable 10 rests at the bottom of the receptacle 38 and the proximal end 10*a* (including the optional mouthpiece 16) protrudes a distance from the surface of the housing 32, e.g., approximately 2 cm of the consumable 10 is exposed/protrudes from the surface of the housing 32 in this example. In this way, the mouthpiece 16 is presented to the user when the consumable 10 is inserted into the receptacle 38.

Surrounding the receptacle 38 is provided a heater 40. In this example, the heater 40 is an annular heater 40 (i.e., a hollow cylindrical element) through which the receptacle 38 passes. More specifically, in this example, the inner surface of the annular heater forms a part of the inner surface of the receptacle 38. This arrangement means that the heater can be provided in close proximity to the surface of the consumable 10, meaning that the heat transfer efficiency from the heater 40 to the consumable 10 can be improved. The heater 40 in this example is formed from, or at least comprises, an electrically resistive material, e.g., nichrome (NiCr), which generates heat when a current is passed through the resistive material. Alternatively, as described above, the heater 40 be resistive or induction heater. For example, the heater could be formed from a magnetic material, such as plated mild steel, magnetic stainless steel or iron. The supply of power from the power cell 34 to the heater 40 is controlled via the control circuitry 36, as mentioned above. The heater 40 is coupled to the control circuitry 36 via any suitable form of electrical coupling, such as via electrically conductive wires 40*a* as shown in FIG. 2.

In order to generate aerosol for user inhalation, the user must first place the consumable 10 in the receptacle 38. Thereafter, the aerosol provision system 20 begins supplying power from the power cell 34 to the heater 40 upon activation of the device 30. In the example shown, this is achieved through use of a user actuated button (not shown) provided on the surface of the housing 32. For example, when the button is pressed once, the control circuitry 36 supplies power to the heater 40 for a predetermined time (e.g., the length of a session, such as 2 to 3 minutes). Accordingly, as power is supplied to the heater 40, the temperature of the heater 40 rises. This subsequently heats the consumable 10 in the receptacle 38 and, more importantly, the aerosol-generating material 12 therein to generate a vapour or aerosol. It is important to note that the aerosol-generating material 12 is heated and not combusted/burnt, hence the aerosol provision system 20 is referred to herein as a non-combustible aerosol provision system. In some implementations, the temperature of the aerosol-generating material during heating is between 150 to 300° C., although it should be appreciated that the precise temperature will depend on the type of aerosol-generating material being heated and the construction of the consumable 10. A user places their lips around the mouthpiece 16 and inhales to draw air from outside the device 30 via an air inlet (not shown) through an opening in the receptacle 38 and through the consumable 10 (e.g., through the aerosol-generating material 12 and generally along a longitudinal axis of the consumable 10). Air drawn in and along the consumable 10 collects vaporised particles released from the aerosol-generating material 12 as the material 12 is heated to form an aerosol which is then passed along the consumable 10, through the mouthpiece 16, before entering the user's mouth/lungs.

Generally, the consumable 10 comprises enough aerosol-generating material to last a session, which equates to approximately 8 to 12 user inhalations. The precise quantity of aerosol-generating material 12 will be dependent on the type of aerosol-generating material 12 in addition to the way in which the device 30 is configured to heat the aerosol-generating material 12. Once the user has finished the session (i.e., the aerosol-generating material is spent), the user will remove and dispose of the consumable 10. To begin a new session, the user inserts a fresh consumable 10.

Figure 3:
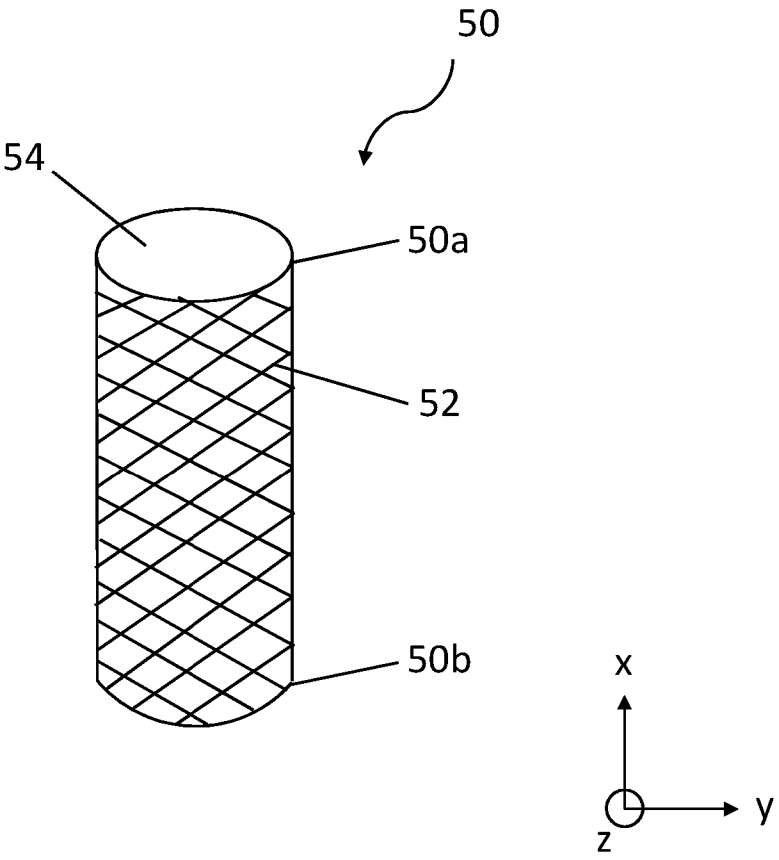
FIG. 3 schematically illustrates a braided absorbent material for a consumable of a non-combustible aerosol provision system according to principles of the present disclosure.

FIG. 3 schematically illustrates a braided absorbent material 50 comprising strands of material 52 braided around the outside of a rod of absorbent material 54 in accordance with principles of the present disclosure.

The braided absorbent material 50 illustrated in FIG. 3 may form part of the consumable 10 as described above, wherein the elongate or x-axis indicated in FIG. 3 corresponds to the x-axis indicated in FIGS. 1 and 2. For example, where the aerosol-generating material 12 is a liquid or gel, the absorbent material 54 is doused with the aerosol-generating liquid and/or gel 12 such that the aerosol-generating liquid and/or gel 12 is contained within the absorbent material 54 when the braided absorbent material 50 forms a part of the consumable 10. Accordingly, the absorbent material 54 is made from a material which is capable of wicking the aerosol-generating material 12. In other words, the absorbent material 54 uses capillary action to draw the aerosol-generating material 12 along the length of the absorbent material 54 so that all of the absorbent material 12 is doused with aerosol-generating material 12. This also allows the aerosol-generating material 12 to be applied one end 50*a* of the absorbent material 54 and the aerosol-generating material 12 to be drawn through the absorbent material 54 such that there is an even distribution of aerosol-generating material 12 within the absorbent material 54. The absorbent material 54 may therefore be made of any material with such wicking properties, for example a fibrous material such as cotton fibres, woolen fibres, silk fibres or other natural fibres, or synthetic fibres such as nylon, polypropylene or polyester fibres.

Although the braided absorbent material 50 illustrated in FIG. 3 has a cylindrical cross-section, it will be appreciated that rods of other cross-sections, such as square, hexagonal or octagonal are also possible. The outer diameter and shape of the braided absorbent material 50 may correspond to that of the consumable 10 such that the braided absorbent material 50 conforms to the outer shape of the consumable 10. Equally, the braided absorbent material 50 may have a different external geometry to the consumable 10, but be sized to fit within the general external shape of consumable 10.

Braided around the outside of the rod of absorbent material 54 are strands of material 52. In other words, strands of material 52 are interweaved around the circumference or perimeter of the rod of absorbent material 54 and along the length of the rod of absorbent material 54 (the x-direction as illustrated in FIG. 3).

The strands of material 52 act to strengthen the absorbent material 54 and ensure that the rod of braided absorbent material 50 maintains a rod shape. In other words, the braided strands of material 52 hold the absorbent material 54 in place and prevent the ends of the absorbent material 54 from splaying outwards and loosing shape. The strands of material 52 may be a metal wire, such aluminium or a steel wire, such as stainless steel, or may be a similar material to the absorbent material 54, such as cotton thread, woolen thread, thread from a natural fibre or a synthetic thread such as nylon. The strands of material 52 may be a magnetic metal wire or other magnetic material suitable to be used in an induction heating system as described above. The thread may have a flavour impregnated into such that the strands of material 52 act as a flavour carrier.

Although the braided strands of material 52 are shown in FIG. 3 as having a uniform or symmetric pattern around the outside of the absorbent material 54, this is not essential, and FIGS. 4*a-d* schematically illustrates alternative braided absorbent materials for a consumable of a non-combustible aerosol provision system in accordance with principles of the present disclosure.

Figures 4A, 4B, 4C, 4D:
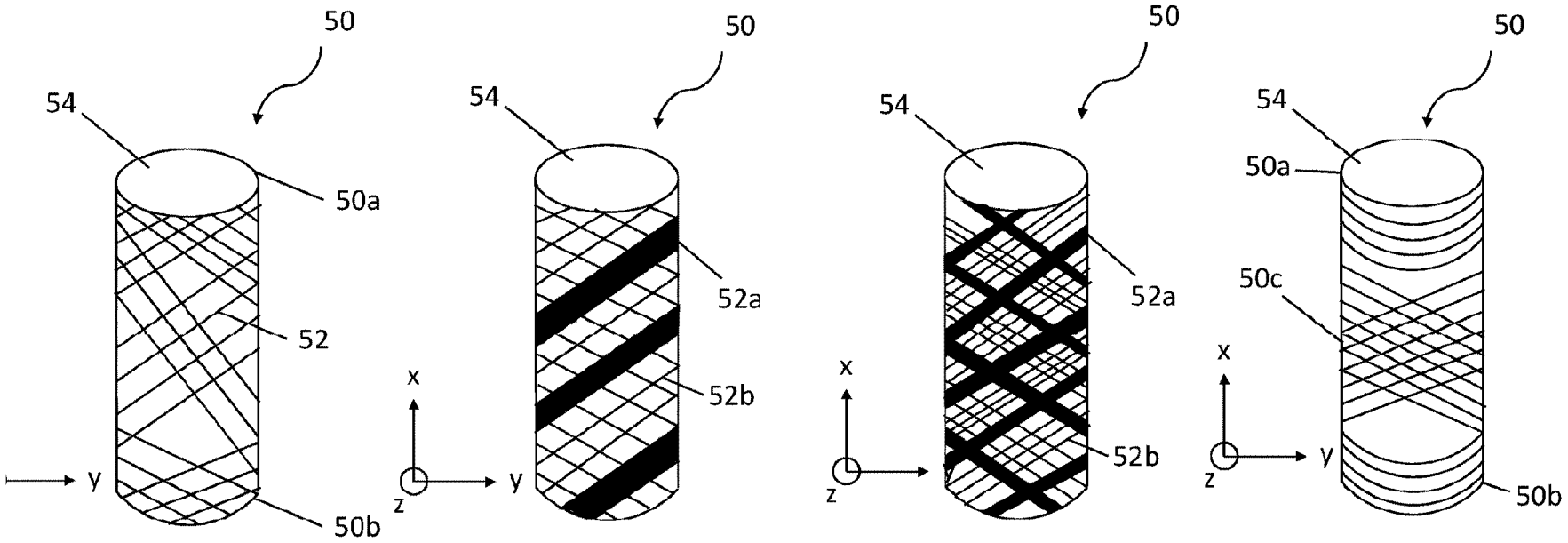
FIGS. 4*a-d* schematically illustrate alternative braided absorbent materials for a consumable of a non-combustible aerosol provision system according to principles of the present disclosure.

FIG. 4*a* illustrates a braided absorbent material 50 where the pattern of the braided strands of material 52 is different in the centre 50*c* of the rod compared to the ends 50*a*, 50*b* of the rod in the elongate or x-axis direction. In other words, the separation between the strands of material 52 changes from the ends 50*a*, 50*b* of the rod to the middle 50*c* of the rod such that the density of the strands of material 52 covering the absorbent material 54 is different between the ends 50*a*, 50*b* of the rod and the middle 50*c* of the rod of braided absorbent material 50. In the example illustrated in FIG. 4*a*, the separation between the strands of material 52 is greater in the middle 50*c* of the rod compared to the ends 50*a*, 50*b* of the rod, and therefore the density of the strands of material 52 covering the absorbent material 54 is lower in the middle 50*c* of the rod compared to the ends 50*a*, 50*b* of the rod. As the absorbent material 54 has a tendency to separate and splay out at the ends of the rod, having a lower separation between the strands of material 52 (and therefore increasing the density of strands of material 52) at the ends 50*a*, 50*b* of the rod reduces the amount of splaying of the absorbent material 54 that occurs since the absorbent material 54 is held together more tightly by the braided strands of material 52. Alternatively, the separation between the strands of material 52 may be less in the middle 50*c* of the rod compared to the ends 50*a*, 50*b* of the rod.

FIG. 4*d* illustrates an alternative example of a braided absorbent material 50 where the pattern of the braided strands of material 52 is different in the centre 50*c* of the rod compared to the ends 50*a*, 50*b* of the rod. In this example, the braided strands of material 52 at the centre 50*c* of the rod form a chequered or criss cross pattern, whilst the braided strands of material 52 at the ends 50*a*, 50*b* of the rod are wrapped around the circumference or outside of the absorbent material 54 with little or no interweaving of the strands. As described above, this also provides a tighter wrapping of the strands of material 52 around the absorbent material 54 at the ends 50*a*, 50*b* of the rod to prevent splaying or separation of the absorbent material 54.

In some examples, strands of material 52 are be knotted together at locations around the outside of the absorbent material 54 in order to fixed the strands of material 52 in place and provide more support to the absorbent material 54. For example, the strands of material 52 can be knotted at the ends of the rod of braided absorbent material 50 in order to prevent the absorbent material 54 from splaying outwards and to prevent the strands of material 52 from unravelling or otherwise moving away from their desired location.

Alternatively or in addition, the strands of material 52 can be fixed into position by heating the rod of braided absorbent material 50 so that the strands of material 52 melt and fuse or otherwise bond together. For example, one or more of the strands of material 52 can be a material with a sufficiently low melting point that heat can be applied to the rod of braided absorbent material 50 in order to melt the material without melting or otherwise damaging any of the other components of the rod of braided absorbent material 50.

FIGS. 4*b* and 4*c* illustrate a braided absorbent material 50 where the strands of material comprise a first material and a second material, and the first material is different from the second material. The first material 52*a* is illustrated in FIGS. 4*b* and 4*c* by the thick lines around the outside of the absorbent material 54, and the second material 52*b* is illustrated in FIGS. 4*b* and 4*c* by the thin lines around the outside of the absorbent material 54. It will be appreciated that this is simply for ease of illustration, and the respective diameters or widths of the first material and the second material may be substantially the same, or the diameters or width of the second material may be greater than the diameters or width of the first material.

The first material 52*a* may be a metal wire, such aluminium or a steel wire, such as stainless steel. When the braided absorbent material 50 forms a part of a consumable for a non-combustible aerosol provision system, the conductive properties of the metal wire can be used as a susceptor material as described above.

The second material 52*b* may also be a metal wire, but a different type of metal wire compared to the first material 52*a*. For example, the second material 52*b* may be a magnetic metal wire whilst the first material is stainless steel wire. Alternatively, the second material 52*b* may be a similar material to the absorbent material 54, such as cotton thread, nylon thread or woolen thread. As described above, the thread may have a flavour impregnated into it such that the second material acts as a flavour carrier whilst the first material acts as a susceptor.

As illustrated in FIGS. 4*b* and 4*c*, the first material 52*a* is be braided around the outside of the rod of absorbent material 54 in a first pattern, and the second material 52*b* is be braided around the rod of absorbent material 54 in a second pattern.

In FIG. 4*b* the first pattern and the second pattern are different. The first pattern is a helical or coil shape whilst the second pattern is forms a chequered or criss cross pattern. Having the first pattern different to the second pattern allows the distribution of the first material 52*a* and second material 52*b* around the outside of the rod of absorbent material 54 to be optimised based on the respective functions of the first material and the second material. For example, where the first material 52*a* is a stainless steel wire and the second material 52*b* is cotton thread, the first material 52*a* may act as a susceptor material, and the pattern of the first material 52*a* can be chosen to provide a consistent distribution of heating along the rod of absorbent material 54. The second material 52*b* (cotton thread) may act as structural enforcement for the rod of absorbent material 54, and therefore the pattern of the second material 52*b* may be chosen to provide additional support at the ends of the rod compared to the centre of the rod in order to prevent the absorbent material 54 from splaying out at the ends of the rod, as described above with reference to FIGS. 4*a* and 4*b*.

FIG. 4*c* illustrates an alternative example of patterns of the first material 52*a* and the second material 52*b*. In this example, the first pattern and the second pattern both result in a chequered or criss cross pattern of the first material 52*a* and the second material 52*b*, but the spacing between the strands of the first material 52*a* and the second material 52*b* are different. In other words, both the first pattern and the second pattern result in a braid of the first material 52*a* and the second material 52*b*, respectively, but the overall density and spacing between the strands of the first material 52*a* and the strands of the second material 52*b* is different. As illustrated in FIG. 4*c*, there are three strands of the second material 52*b* between each strand of the first material 52*a*, such that the density of the second material 52*b* around the outside of the absorbent material 54 is greater than the density of the first material 52*a* around the outside of the absorbent material 54. In other words, the spacing between each strand of the first material is greater than the spacing between each strand of second material 52*b* around the outside of the absorbent material. Alternatively, the first pattern and the second pattern may be different such that the density of the second material 52*b* around the outside of the absorbent material 54 is less than the density of the first material 52*a* around the outside of the absorbent material 54, and therefore the spacing between each strands of the second material 52*b* is greater than the spacing between each strands of the first material 52*a* around the outside of the absorbent material 54.

Figure 5:
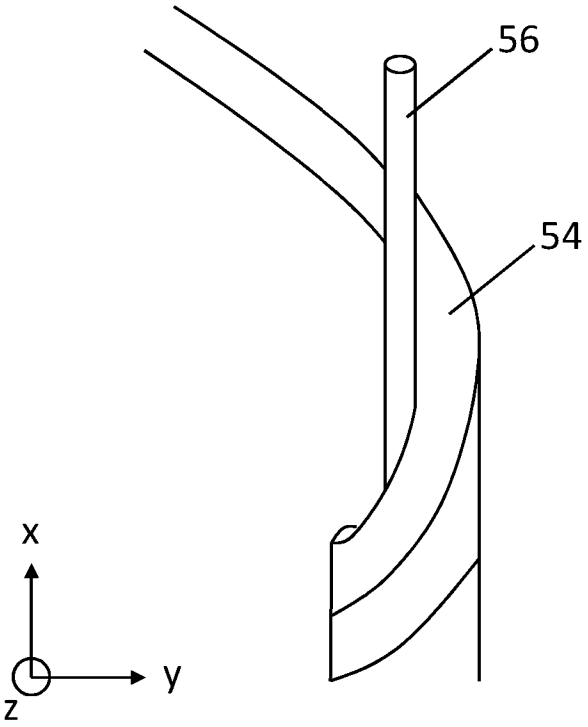
FIG. 5 schematically illustrates a rod of absorbent material according to principles of the present disclosure.

FIG. 5 schematically illustrates a rod of absorbent material 54 formed by wrapping the absorbent material 54 around a continuous core of material 56 in accordance with principles of the present disclosure. The continuous core of material 56 could be formed of a metallic wire in order to act as a susceptor material as described above. This may be in addition to or in the place of a susceptor in the strands of material 52 braided around the outside of the rod of absorbent material 54. The continuous core of material 56 may be formed of a metallic wire or plastics material to act as a structural support for the absorbent material 54 such that the rod of absorbent material 54 maintains its shape. In some applications, the continuous core of material 56 may be a hollow tube, for example made of a plastics or metallic material, thereby providing an additional air path through the rod of absorbent material 54 when the rod of braided absorbent material 50 forms part of a consumable 10 for a non-combustible aerosol provision system 20. It will be appreciated that the continuous core of material 56 may provide multiple functions, for example a hollow metallic tube to act as a susceptor material and provide an additional air path.

In some examples, the continuous core of material 56 could be another rod of braided absorbent material. In other words, a first braided rod of absorbent material as described herein is provided, and additional absorbent material is wrapped around the outside of it. In other words, absorbent material is wrapped around the strands of material braided on the first braided rod. Strands of material are then braided around the outside of the additional absorbent material to form a second braided rod of absorbent material which contains the first braided rod of absorbent material as a core of material. This results in a first, inner, braided rod of absorbent material inside a second, outer, braided rod of absorbent material, where the first and second braided rods of absorbent material are co-axial. The first braided rod of absorbent material may also contain a continuous core of material. It will be appreciated that such a layering of absorbent material and braided strands of material around the outside of a rod of braided absorbent material can be continued in order to create a final, complete rod of braided absorbent material of the desired diameter or with the desired number of consistent layer of absorbent material and braided strands. The strands of material which form the first braided rod of absorbent material could be formed of a metal wire, such as a magnetic metal wire, to act as a susceptor material as described herein, whilst the strands of material which form the second braided rod of absorbent material could be formed of cotton thread, or vice-versa.

Figure 6:
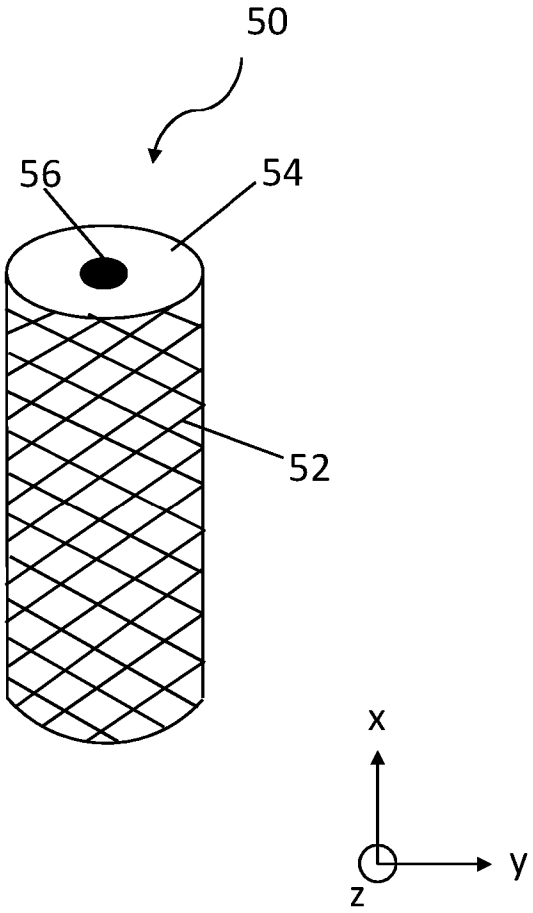
FIG. 6 schematically illustrates a braided absorbent material including the rod of absorbent material illustrated in FIG. 5 according to principles of the present disclosure.

FIG. 6 schematically illustrates a rod of braided absorbent material 50 including the rod of absorbent material 54 illustrated in FIG. 5 in accordance with principles of the present disclosure. As illustrated in FIG. 6, the strands of material 52 are braided around the outside of the rod of absorbent material 54, which includes the continuous core of material 56, as described above with reference to FIGS. 3 and 4.

Figure 7:
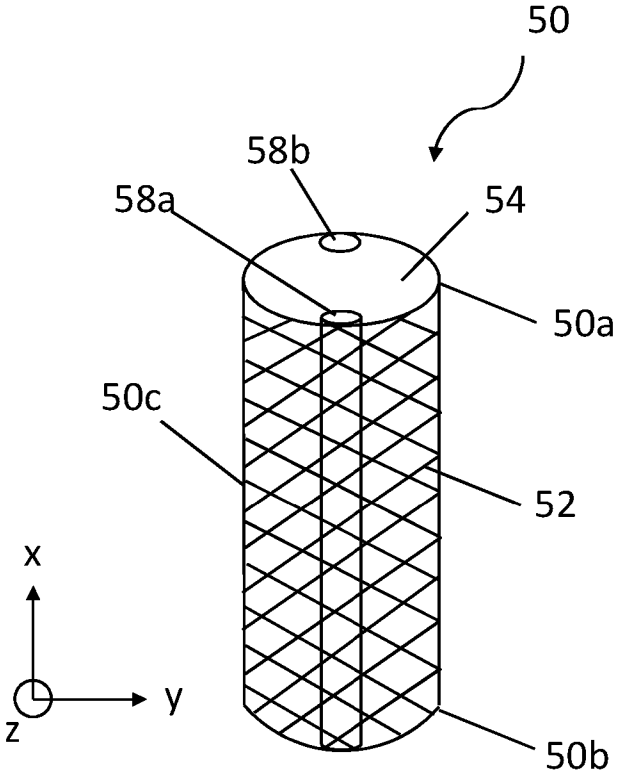
FIG. 7 schematically illustrates a rod of braided absorbent material according to principles of the present disclosure.

FIG. 7 schematically illustrates a rod of braided absorbent material 50 in accordance with principles of the present disclosure, where one or more additional materials 58*a*, 58*b* are laid on the outside of the rod of absorbent material 54 before the strands of material 52 are braided around the outside of the rod of absorbent material 54. In other words, the additional material 58 lies between the rod of absorbent material 54 and the branded strands of material 52. The additional materials 58 may include a metallic wire, for example to act as a susceptor, and/or a metallic or plastics material to provide structural reinforcement to the rod of absorbent material 54. The additional materials 58 may include one or more threads, such as cotton or wool, which are impregnated with flavouring such that the additional material 58 acts as a flavour carrier. The additional materials 58 may include a hollow plastics or metallic tube, where the hollow portion of the tube provides an air path through the rod of braided absorbent material 50 when the rod of braided absorbent material 50 forms part of a consumable 10 for a non-combustible aerosol provision system 20. When there are two or more additional materials 58*a*, 58*b*, each material may be the same or it may be different. For example, the first additional material 58*a* may be a metal wire whilst the second additional material 58*b* may be a thread impregnated with a flavourant.

Although the additional materials 58*a*, 58*b* are illustrated in FIG. 7 as extending along the entire length of the rod of braided absorbent material 50 in the x-direction, this is not essential. In other examples the additional material 58 may be located in the middle 50*c* of the rod of braided absorbent material 50 in the elongate or x-direction such that the additional material does not extend fully to the ends 50*a*, 50*b* of the rod. Alternatively, the additional material 58 may be located at one or more ends 50*a*, 50*b* of the rod and not present in the middle 50*c* of the rod. Equally the additional material 58 may not be axially aligned with the rod of braided absorbent material 50. In other words, the additional material 58 may not extend straight along the elongate or x-axis of the rod of braided absorbent material 50. For example, the additional material 58 may be helically wound around the rod of absorbent material 54 or wrapped partially or fully around the circumference or perimeter of the rod of absorbent material 54 perpendicular to the elongate or x-axis of the rod. In the case where the additional material 58 is helically wound around the rod of absorbent material 54, the helix or coil of additional material 58 may follow a similar path around the outside of the rod of absorbent material 54 as one or more of the strands of material 52 that are braided around the outside of the rod of absorbent material 54.

Figure 8:
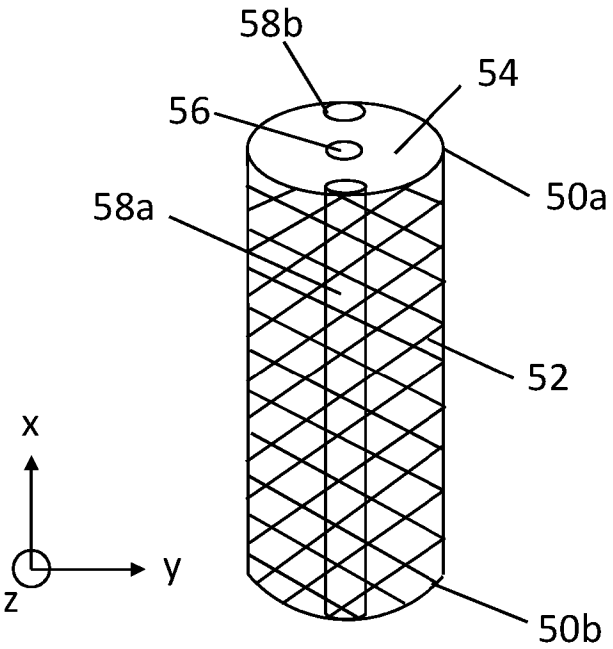
FIG. 8 schematically illustrates a rod of braided absorbent material according to principles of the present disclosure.

FIG. 8 schematically illustrates a rod of braided absorbent material 50 in accordance with principles of the present disclosure. In the example illustrated in FIG. 8, the rod of braided absorbent material 50 includes both a continuous core of material 56 as described above in relation to FIG. 6 and one or more additional materials 58*a*, 58*b* laid on the outside of the rod of absorbent material 54 as described above in relation to FIG. 7. Accordingly, the features described above in relation to these figures may be used in combination. It will also be appreciated that any of the features of the braided strands of material 52 and the absorbent material 54, in particular those described above with reference to FIGS. 3 and 4, may also be used in combination with the examples illustrated in FIGS. 5 to 8.

Although two additional materials 58*a*, 58*b* are shown in FIGS. 7 and 8, it will be appreciated that any number of additional materials, such as one, five or 10, may be laid around the outside of the rod of absorbent material 54. Further, although the additional materials 58*a*, 58*b* are shown in FIGS. 7 and 8 to be evenly distributed around the circumference or perimeter of the rod of absorbent material 54, this is not essential. For example, where there are two additional materials 58*a*, 58*b*, these may be located proximate to each other around the circumference or perimeter of the rod of absorbent material 54 rather than diametrically opposite each other.

Any of the rods of braided absorbent material 50 described above with reference to FIGS. 3 to 9 may form part of the consumable 10 as described above with reference to FIGS. 1 and 2, where the reference frames in each figure are the same. Accordingly, any of the rods of braided absorbent material 50 described above with reference to FIGS. 3 to 9 may form part of the consumable 10 for a non-combustible aerosol provision system 20.

Figure 9:
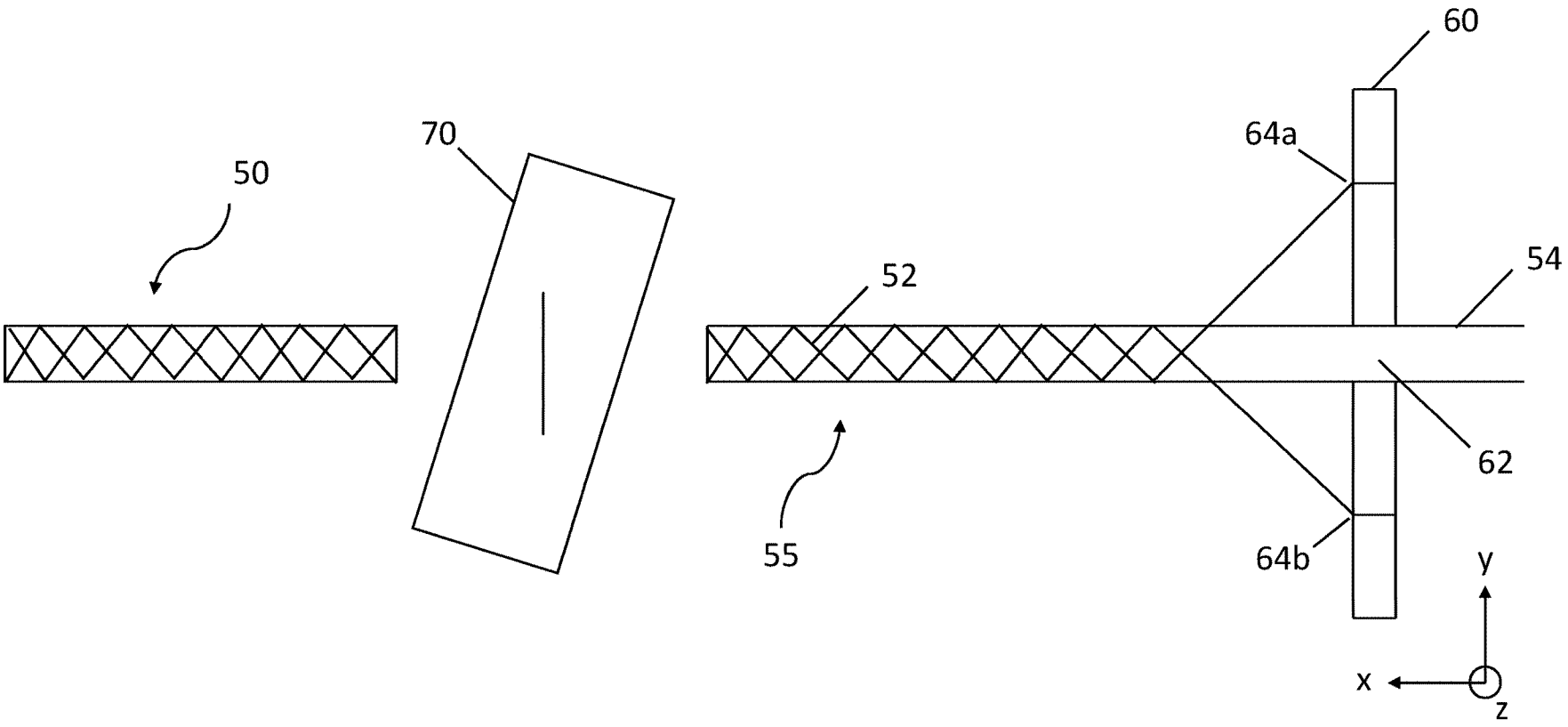
FIG. 9 schematically illustrates a method of manufacturing the braided absorbent material illustrated in FIG. 3 according to principles of the present disclosure.

FIG. 9 schematically illustrates a method of manufacturing the rod of braided absorbent material 50 illustrated in FIG. 3 in accordance with principles of the present disclosure. Strands of material 52 are braided around the outside of a continuous rod of absorbent material 54 to form a continuous rod of braided material 55. The continuous rod of braided material 55 is then cut into lengths of braided absorbent material 50. Each length of braided absorbent material then corresponds to the rod of braided absorbent material 50 illustrated in FIG. 3. In other words, each length includes at least a portion of the rod of absorbent material 54.

The braiding of the strands of material 52 in FIG. 9 is performed by a braiding machine 60, such as a gear horn braider or a circular braider. The continuous rod of absorbent material 54 is drawn through an aperture 62 of the braiding machine so that the strands of material 52 can be braided around the outside of the continuous rod of absorbent material 54.

The braiding machine 60 can comprise three or more bobbins 64*a*, 64*b* which supply the strands of material 52. The bobbins pass either side of one another whilst rotating around the continuous rod of absorbent material 54 in order to braid and interweave the strands of material around the outside of the continuous rod of absorbent material 54. Each bobbin may supply a strand of the same material or a different material, such as in the examples described above with reference to FIGS. 4*b* and 4*c* where there are two or more different strands of material 52*a*, 52*b* braided around the outside of the rod of absorbent material 54. In other words, where the strands of material comprise a first material 52*a* and a second material 52*b*, the number of bobbins 64*a* which supply the first material 52*a* and the number of the bobbins 62*b* which supply the second material 52*b* can be selected in order to produce the desired density or pattern of the first material 52*a* and the second material 52*b* around the outside of the rod of absorbent material 54. For example, there may be two bobbins which supply the first material 52*a* and one bobbin which supplies the second material 52*b*, or two bobbins which supply the first material 52*a* and two bobbins which supply the second material 52*b* in order to produce the desired density or pattern of the first material 52*a* and the second material 52*b* around the outside of the rod of absorbent material 54.

Although not shown in FIG. 9, the continuous rod of absorbent material 54 may be supplied from a reel, such as a reel of cotton or woolen fibres, and drawn from the reel and through the aperture 62 of the braiding machine 60. The braiding machine 60 may further comprise a controller (not shown) configured to match the braiding operation to a draw speed of the continuous rod of absorbent material 54 through the aperture 62 of the braiding machine 60. In other words, the controller is configured to braid the strands of material 52 around the outside of the continuous rod of absorbent material 54 at a speed that is proportional to the speed at which the continuous rod of absorbent material 54 passes through the aperture 62 of the braiding machine 60. This results in a uniform pattern of braided strands of material 52 around the outside of the continuous rod of absorbent material 54, as illustrated in FIG. 9. As described above, other patterns of braided strands of material 52 around the outside of the continuous rod of absorbent material 54 are also possible. In these cases, the controller of the braiding machine 60 is be configured to alter the speed at which each of the bobbins 64*a*, 64*b* pass either side of one another and the speed at which each bobbin rotates around the outside of the continuous rod of absorbent material 54 in order to change the pattern of the braiding operation. For example, if each of the bobbins 64*a*, 64*b* are configured to rotate around the outside of the continuous rod of absorbent material 54 without passing either side of one another, this results in the strands of material being wrapped around the continuous rod of absorbent material 54 as illustrated at the ends 50*a*, 50*b* of the rod 50 in FIG. 4*d*. The speed at which the bobbins 64*a*, 64*b* rotate around the outside of the continuous rod of absorbent material 54 determines the density and tightness of the strands of material around the outside of the rod of absorbent material 54. The controller can then configure the bobbins 64*a*, 64*b* to begin to pass either side of one another in order to create the braided pattern illustrated in the middle 50*c* of the rod 50 in FIG. 4*d*. The speed of the rotation and passing of the bobbins 64*a*, 64*b* can also be changed relative to the draw speed of the continuous rod of absorbent material 54 through the aperture 62 of the braiding machine 60 in order to create the desired density and/or pattern of the strands of material 52 around the outside of the rod of absorbent material 54. The controller can also be configured to control the bobbins 64*a*, 64*b* in order to knot the strands of material 52 as described above. The controller is configured to control the speed of the bobbins and the draw speed of the continuous rod of absorbent material 54 in order to control the outside or external circumference of the continuous rod of absorbent material 54. The outside circumference of the continuous rod of absorbent material 54 could be measured by a sensor not shown in the figures, for example an optical, x-ray and/or microwave sensor or any other means to measure a distance in a continuous process. The controller is then configured to receive the data from the sensor or other measurement means and control the speed of the bobbins and the draw speed of the continuous rod of absorbent material 54 to control the outside circumference of the continuous rod of absorbent material 54 based on the received data.

The continuous rod of braided material 55 is cut into lengths of braided absorbent material 50 by a cutter 70, such as a cutting blade. As shown in FIG. 9, the continuous rod of absorbent material 54 (and as a result the continuous rod of braided material 55) is continuous in a first direction, the x-direction as indicated in FIG. 9. The cutting is performed perpendicular to the first direction, or the y-direction as indicated in FIG. 9. This results in a length of braided absorbent material 50 which is elongate in the first, x-direction, with planar surfaces at each end 50*a*, 50*b*. The cutter 70 is configured to cut the continuous rod of braided material 55 at regular intervals such that each length of braided absorbent material 50 has substantially the same length. In other words, the frequency at which the cutter 70 cuts the continuous rod of braided material 55 is proportional to the draw speed of the continuous rod of absorbent material 54 through the braiding machine 60.

The cutter 70 cuts the continuous rod of braided material 55 to create the first end 50*a* of length of braided absorbent material 50 and the second end 50*b* of an adjacent length of braided absorbent material 50. Accordingly, where the braid pattern of the strands of material changes along the length of the rod of braided absorbent material 50, such as illustrated in FIGS. 4*a* and 4*d*, the controller is configured to control the bobbins 64*a*, 64*b* to create the desired pattern around the continuous rod of absorbent material 54 at a frequency that matches the cutting frequency of the cutter 70 in order to ensure that each length of braided absorbent material 50 has the same braid pattern. In other words, the controller is configured to control the bobbins 64*a*, 64*b* to create a periodic pattern of braided strands of material along the continuous rod of braided absorbent material 50 such that the resulting pattern of braided strands of material along each length of braided absorbent material 50 is substantially the same.

Figure 10:
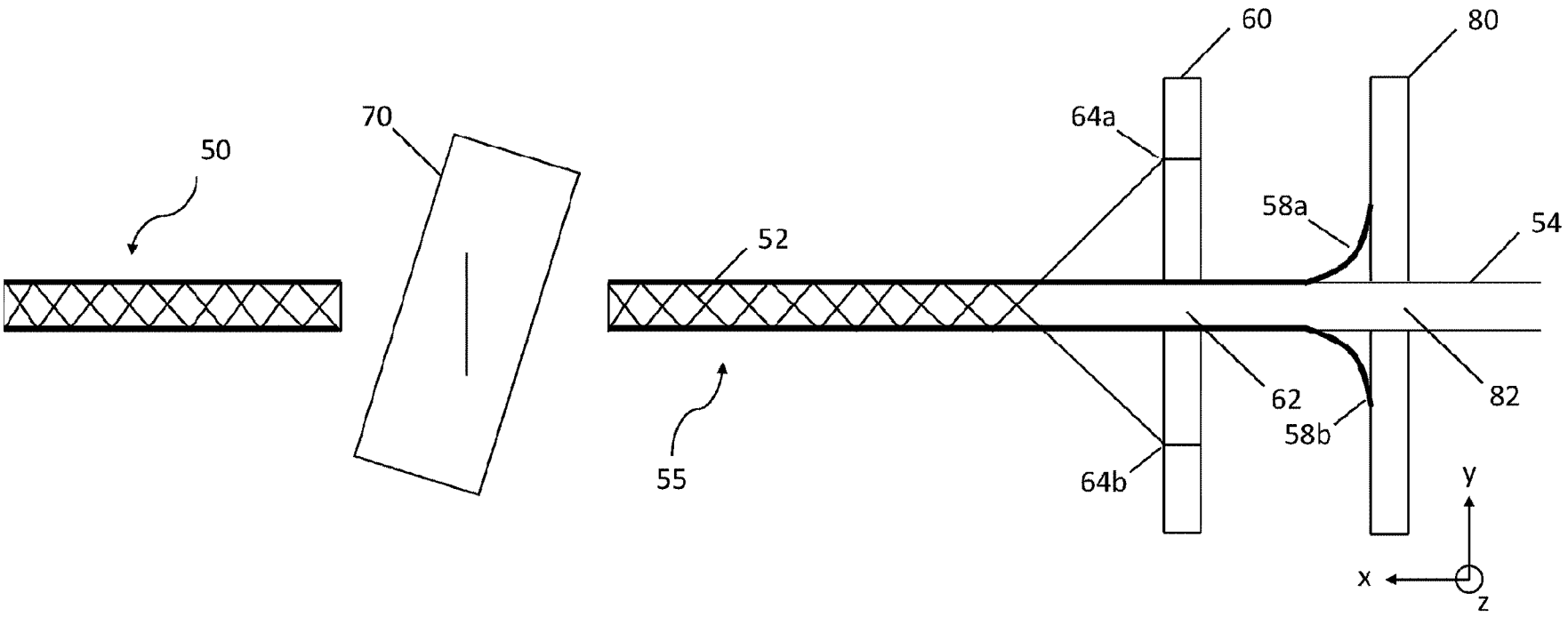
FIG. 10 schematically illustrates a method of manufacturing the braided absorbent material illustrated in FIG. 7 according to principles of the present disclosure.

FIG. 10 schematically illustrates a method of manufacturing the braided absorbent material 50 illustrated in FIG. 7 in accordance with principles of the present disclosure. The method has the same steps as described above with reference to FIG. 9, but in this example one or more additional materials 58*a*, 58*b* are laid on the outside of the continuous rod of absorbent material 54 before the strands of material 52 are braided around the outside of a continuous rod 54 of absorbent material to form a continuous rod of braided material 55. As illustrated in FIG. 10, an additional device 80 is used to lay the one or more additional materials 58*a*, 58*b* onto the outside of the continuous rod of absorbent material 54. The continuous rod of absorbent material 54, including the one or more additional materials 58*a*, 58*b*, is then drawn through the aperture 62 of the braiding machine 60 as described above. The continuous rod of absorbent material 54 is supplied from a reel (not shown) and drawn through an aperture 82 of the additional device 80 so that the additional material 58*a*, 58*b* can be laid on either side of the continuous rod of absorbent material 54. Alternatively, the additional device 80 may comprise separate devices circumferentially spaced around the continuous rod of absorbent material 54 in order to lay additional material 58*a*, 58*b* at the desired circumferential locations around the outside of the continuous rod of absorbent material 54. Each additional material 58*a*, 58*b* is then supplied from a separate reel if each additional material 58*a*, 58*b* is different.

The additional device 80 may provide a means of laying discrete lengths or pieces of additional material 58*a*, 58*b* onto the continuous rod of absorbent material 54, as described above in relation to FIG. 7. This laying operation and the resulting separation between each length or piece of additional material 58*a*, 58*b* is then matched to the draw speed of the continuous rod of absorbent material 54 and the cutting frequency of the cutter 70 to ensure that each length of braided absorbent material 50 contains the desired number of lengths or pieces of additional material 58*a*, 58*b* at the desired locations. This laying operation may be controlled by a controller of the additional device which is in communication with the controller of the braiding machine 60 and/or the cuter 70. The additional device 80 may for a part of the braiding machine 60, and in this case the controller of the braiding machine is configured to match the laying operation to the draw speed of the continuous rod of absorbent material 54.

Figure 11:
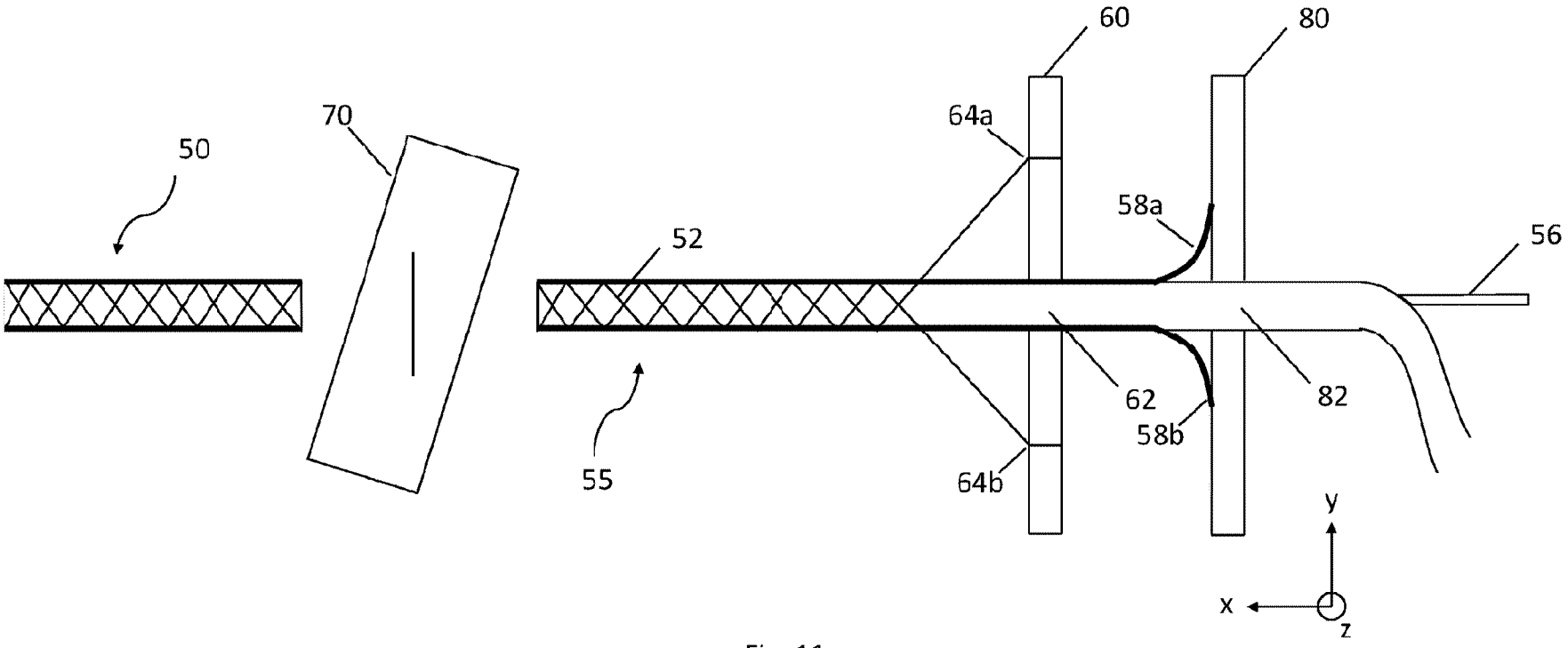
FIG. 11 schematically illustrates a method of manufacturing the braided absorbent material illustrated in FIG. 8 according to principles of the present disclosure.

FIG. 11 schematically illustrates a method of manufacturing the braided absorbent material 50 illustrated in FIG. 8 in accordance with principles of the present disclosure. The method has the same steps as described above with reference to FIGS. 9 and 10, but in this example the continuous rod of absorbent material 54 is formed by wrapping the absorbent material 54 around a continuous core of material 56. The continuous core of material 56 can be supplied from a reel or formed by extrusion or other suitable forming process. The absorbent material 54 is then wrapped around the outside of the continuous core of material 56 to form the continuous rod of absorbent material 54. In some examples, the absorbent material 54 is supplied from a reel which is rotated or otherwise passed around the outside of the continuous core of material 56 in order to wrap the absorbent material 54 around the continuous core of material 56. The speed of the rotation of the reel is then matched to the drawn speed of the continuous rod of absorbent material 54 to ensure an even and completed coverage of the absorbent material 54 around the outside of the continuous core of material 56. Alternatively, the absorbent material 54 can be supplied from multiple reels circumferentially spaced around the continuous core of material 56, and the absorbent material 54 laid onto the continuous core of material 56. In this example, the number of reels and the separation between the reels is selected to ensure an even and completed coverage of the absorbent material 54 around the outside of the continuous core of material 56.

It will be appreciated that the methods described above with reference to FIGS. 9 and 11 can be used in any combination. For example, the length of braided absorbent material 50 illustrated in FIG. 6 can be formed using the process illustrated in FIG. 11 but omitting the additional device 80 and the step of laying one or more additional materials 58*a*, 58*b* on the outside of the continuous rod of absorbent material 54.

Further, as described above with reference to FIG. 5, in some examples the continuous rod of braided material 55 is used as the continuous core of material 56 in order for additional absorbent material 54 and strands of material 52 to be layered on top of the continuous rod of braided material 55 in order to create a second continuous rod of braided material 55 which has the first continuous rod of braided material as a continuous core. In other words, the second continuous rod of braided material is created around the outside of the first continuous rod of braided material using the method described above with reference to FIG. 11. This operation can be repeated, in other words the second continuous rod of braided material is used as the continuous core of material at the beginning of the method described with reference to FIG. 11, in order to create a continuous core of material with the desired number of layers of absorbent material and strands of braided material. Once the desired continuous rod of braided material has been made, it can then be cut into cut into lengths of braided absorbent material 50 by the cutter 70 as described above.

Figure 12:
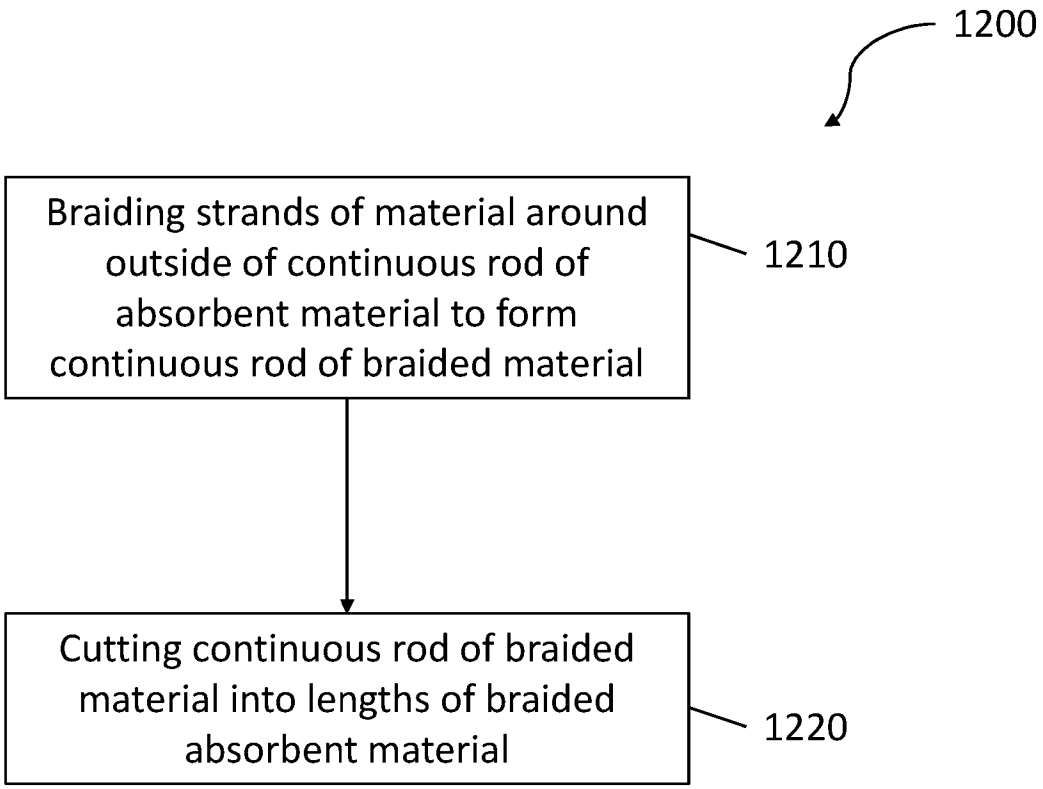
FIG. 12 is a flow chart of a method of manufacturing a braided absorbent material for a consumable of a non-combustible aerosol provision system according to principles of the present disclosure.

FIG. 12 is a flow chart of a method 1200 of manufacturing a braided absorbent material 50 for a consumable 10 of a non-combustible aerosol provision system 20 in accordance with principles of the present disclosure. The method 1200 begins at step 1210, where strands of material 52 are braided around the outside of a continuous rod of absorbent material 54 to form a continuous rod of braided material 55. At step 1220, the continuous rod of braided material 55 is cut into lengths of braided absorbent material 50, such that each length includes at least a portion of the rod of absorbent material 54. The lengths of braided absorbent material correspond to the rods of braided absorbent material 50 as described above in relation to FIGS. 3 and 4.

Figure 13:
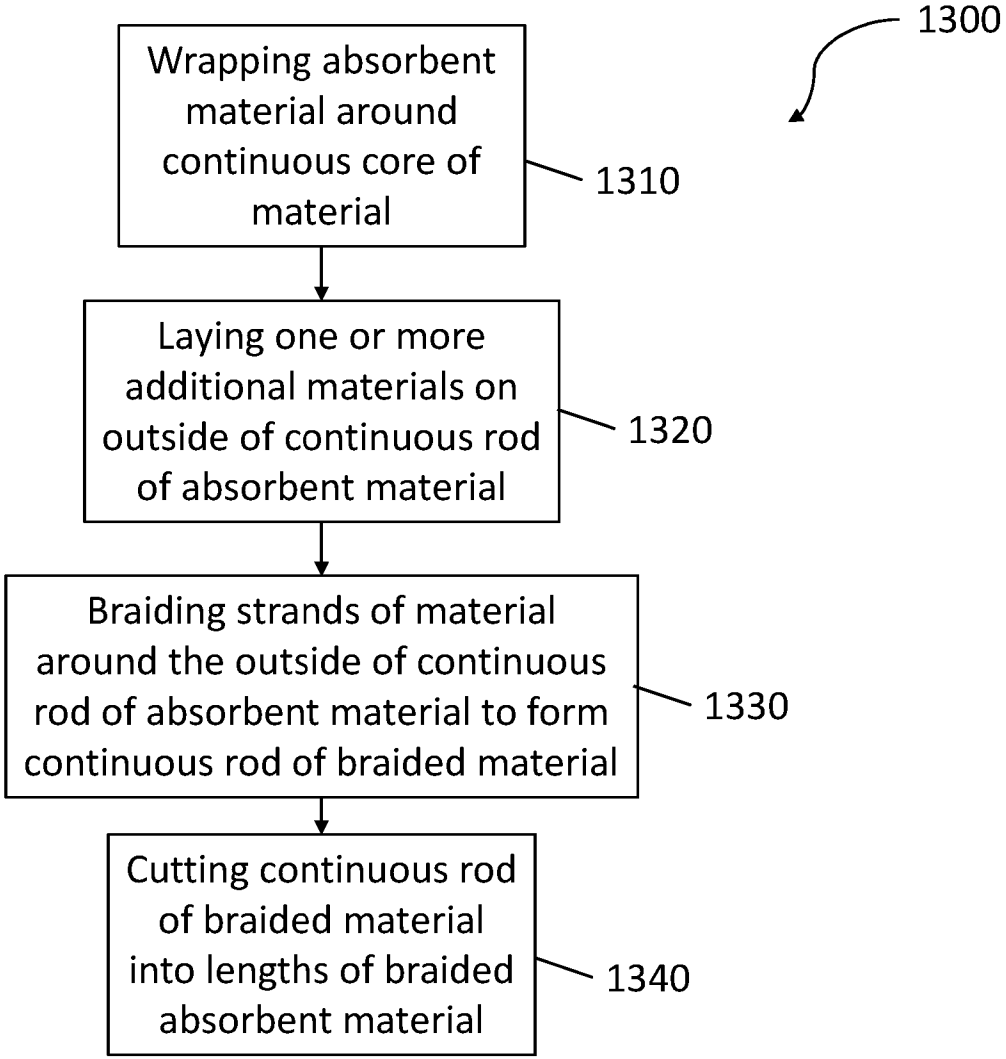
FIG. 13 is a flow chart of a method of manufacturing a braided absorbent material for a consumable of a non-combustible aerosol provision system according to principles of the present disclosure.

FIG. 13 is a flow chart of a further method 1300 of manufacturing a braided absorbent material 50 for a consumable 10 of a non-combustible aerosol provision system 20 in accordance with principles of the present disclosure. The method begins at step 1310, where absorbent material 54 is wrapped around a continuous core of material 56 to form a continuous rod of absorbent material 54. At step 1320, one or more additional materials 58*a*, 58*b* are laid on the outside of the continuous rod of absorbent material 54. At step 1330, strands of material 52 are braided around the outside of a continuous rod of absorbent material 54 to form a continuous rod of braided material 55. At step 1340, the continuous rod of braided material 55 is cut into lengths of braided absorbent material 50, such that each length includes at least a portion of the rod of absorbent material 54. The lengths of braided absorbent material correspond to the rods of braided absorbent material 50 as described above in relation to FIG. 8. It will be appreciated that steps 1330 and 1340 correspond, respectively, to steps 1210 and 1220 of the method 1200 illustrated in FIG. 12.

As described above, the present disclosure relates to (but it not limited to) a braided absorbent material for use in a consumable of a non-combustible aerosol provision system.

Thus, there has been described a method of manufacturing a braided absorbent material for a consumable of a non-combustible aerosol provision system. The method comprises braiding strands of material around the outside of a continuous rod of absorbent material to form a continuous rod of braided material and cutting the continuous rod of braided material into lengths of braided absorbent material, where each length includes at least a portion of the rod of absorbent material.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method of manufacturing a consumable for a non-combustible aerosol provision system, the method comprising:

braiding strands of material around the outside of a continuous rod of absorbent material to form a continuous rod of braided material; and forming individual consumables by cutting the continuous rod of braided absorbent material into lengths of braided absorbent material, wherein each length includes at least a portion of the rod of absorbent material, and wherein the shape of each length of braided absorbent material corresponds to an outer shape of the consumable;

wherein the strands of material comprise at least a first material and a second material, wherein the first material is different to the second material; and wherein the braiding creates a first pattern of strands of the first material and a second pattern of strands of the second material, wherein the first pattern is different to the second pattern.

2. The method of claim 1, wherein the braiding creates a uniform pattern of strands of material around the outside of the continuous rod of absorbent material.

3. The method of claim 1 or claim 2, wherein the continuous rod of absorbent material is continuous in a first direction and the cutting is performed perpendicular to the first direction.

4. The method of claim 1, wherein a braiding machine performs the braiding, and the continuous rod of absorbent material is drawn through an aperture of the braiding machine.

5. The method of claim 4, wherein the strands of material are supplied from three or more bobbins on the braiding machine.

6. The method of claim 4, wherein the braiding machine comprises a controller configured to match the braiding to a draw speed of the continuous rod of absorbent material through the aperture of the braiding machine.

7. The method of claim 4, wherein the continuous rod of absorbent material is supplied from a reel.

8. The method of claim 1, wherein the absorbent material is cotton fibres.

9. The method of claim 1, wherein the first material is metal wire.

10. The method of claim 9, wherein the metal wire is a magnetic metal wire.

11. The method of claim 1, wherein the second material is cotton thread.

12. The method of claim 1, wherein the continuous rod of absorbent material is formed by wrapping the absorbent material around a continuous core of material.

13. The method of claim 1, wherein one or more additional materials are laid on the outside of the continuous rod of absorbent material before the braiding.

* * * * *